US011802029B1

(12) United States Patent
Troegel

(10) Patent No.: US 11,802,029 B1
(45) Date of Patent: Oct. 31, 2023

(54) BOAT HOIST CARRIER

(71) Applicant: Paul Courtney Troegel, Webster, TX (US)

(72) Inventor: Paul Courtney Troegel, Webster, TX (US)

( * ) Notice: Subject to any disclaimer, the term of this patent is extended or adjusted under 35 U.S.C. 154(b) by 30 days.

(21) Appl. No.: 17/534,074

(22) Filed: Nov. 23, 2021

Related U.S. Application Data

(60) Provisional application No. 63/117,269, filed on Nov. 23, 2020.

(51) Int. Cl.
*B66D 1/12* (2006.01)
*B66D 3/20* (2006.01)
*B63C 3/06* (2006.01)

(52) U.S. Cl.
CPC ..... *B66D 1/12* (2013.01); *B63C 3/06* (2013.01); *B66D 3/20* (2013.01)

(58) Field of Classification Search
CPC . B66D 1/12; B66D 1/365; B66D 1/28; B66D 1/36; B66D 3/20; B66D 3/26; B66D 2700/025; B66C 3/06; B66C 13/02; B66B 9/187; B66B 23/02; B66B 23/40; A63J 1/02
USPC ..... 254/362
See application file for complete search history.

(56) References Cited

U.S. PATENT DOCUMENTS 3,072,931 A * 1/1963 Miller ..... B63B 71/00 254/296
3,568,468 A * 3/1971 Dechantsreiter et al. ..... B66D 1/28 254/285
3,675,258 A * 7/1972 Osmundson ..... B63C 3/06 405/218
4,736,929 A * 4/1988 McMorris ..... B66D 1/22 254/323
4,776,429 A * 10/1988 Osborn ..... B65G 69/22 182/147
2020/0115199 A1* 4/2020 Armfield ..... B66D 1/12

FOREIGN PATENT DOCUMENTS

CN 112299276 A * 2/2021 ..... B66D 1/36

* cited by examiner

*Primary Examiner* — Michael R Mansen
*Assistant Examiner* — Henrix Soto
(74) *Attorney, Agent, or Firm* — Plager Schack LLP; Mark H. Plager; Michael J. O'Brien

(57) ABSTRACT

An aluminum boat hoist carrier is configured to lift a vessel above a ground surface. The boat hoist carrier has a first aluminum c-channel having a first plurality of block attachment openings, at least one first channel grease opening, a first plurality of structure attachment openings, and a second plurality of structure attachment openings. Two billet aluminum pillow blocks are attached to the first and second plurality of structure attachment openings. A second c-aluminum channel has a second plurality of block attachment openings, at least one second aluminum channel grease opening, a third plurality of structure attachment openings attached to the first billet aluminum pillow block, and a fourth plurality of structure attachment openings attached to the second billet aluminum pillow block.

4 Claims, 3 Drawing Sheets

BOAT HOIST CARRIER

RELATED APPLICATION

This application claims priority to provisional patent application U.S. Ser. No. 63/117,269 filed on Nov. 23, 2020, the entire contents of which is herein incorporated by reference.

BACKGROUND

The embodiments herein relate generally to devices that maneuver vessels.

Prior to embodiments of the disclosed invention, legacy, galvanized boat hoist carriers were fabricated from soft structural angle iron with welds that cracked from fatigue and corrosion. Spooler bearings were cut from soft galvanized steel pipe that bend or wear out under load. Cables corroded, frayed and needed to be replaced often and retained memory when a load was released and became tangled and fouled inside the mechanism.

SUMMARY

A boat hoist carrier is configured to lift a vessel above a ground or marine surface. The boat hoist carrier comprises a first aluminum c-channel further comprising a first plurality of block attachment openings, at least one first channel grease opening, a first plurality of structure attachment openings, and a second plurality of structure attachment openings. A first billet aluminum pillow block is joined to the first plurality of structure attachment openings. A second billet aluminum pillow block is joined to the second plurality of structure attachment openings.

A second aluminum c-channel further comprises a second plurality of block attachment openings, at least one second channel grease opening, a third plurality of structure attachment openings attached to the first billet aluminum pillow block, and a fourth plurality of structure attachment openings attached to the second billet aluminum pillow block. A drive pipe is arranged through the first billet aluminum pillow block and the second billet aluminum pillow block. A live hoist line is coiled around the drive pipe forming a dead hoist line and tethered to a line attachment point on the first aluminum c-channel. A motor is attached to the drive pipe, wherein arranging the motor coils or uncoils the dead hoist line from the drive pipe causing the vessel to raise or lower.

A first set of carrier attachment bolts is arranged through the first plurality of structure attachment openings, the first billet aluminum pillow block and the third plurality of structure attachment openings and secured with a first set of nuts. A second set of carrier attachment bolts is arranged through the second plurality of structure attachment openings, the second billet aluminum pillow block and the fourth plurality of structure attachment openings and secured with a second set of nuts.

A reduction gear is attached to the motor in order to change a rotational speed and a rotational torque of the motor. An overhead structure is attached to the first aluminum c-channel and the second aluminum c-channel in order to provide structural support for the boat hoist carrier.

BRIEF DESCRIPTION OF THE FIGURES

The detailed description of some embodiments of the invention is made below with reference to the accompanying figures, wherein like numerals represent corresponding parts of the figures.

DETAILED DESCRIPTION OF CERTAIN EMBODIMENTS

Figure 1:
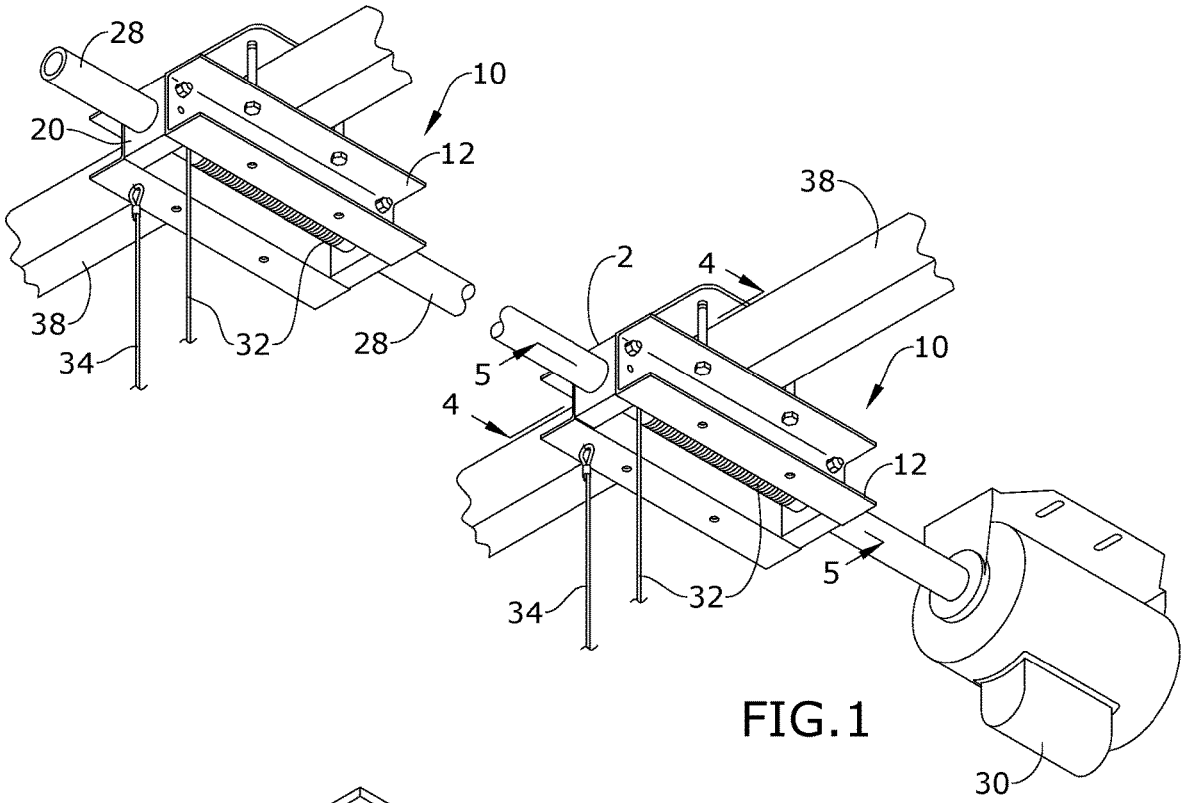
FIG. 1 shows a perspective view of one embodiment of the present invention.
Figure 2:
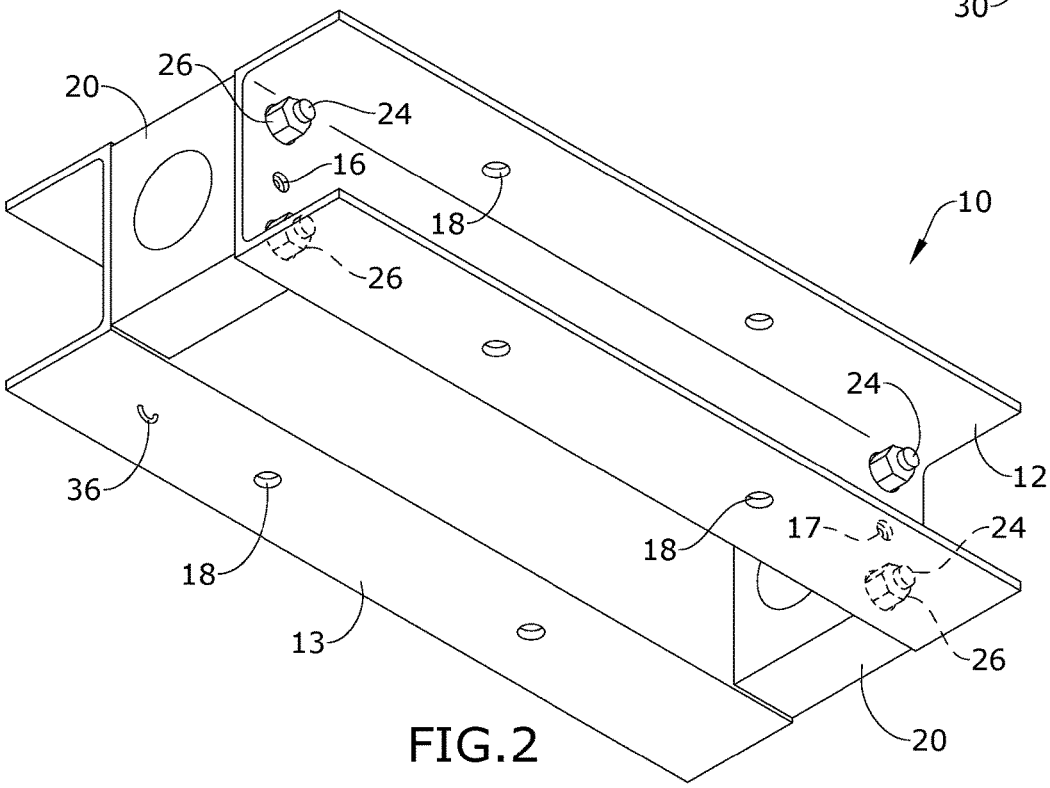
FIG. 2 shows a perspective view of a carrier assembly of one embodiment of the present invention.
Figure 3:
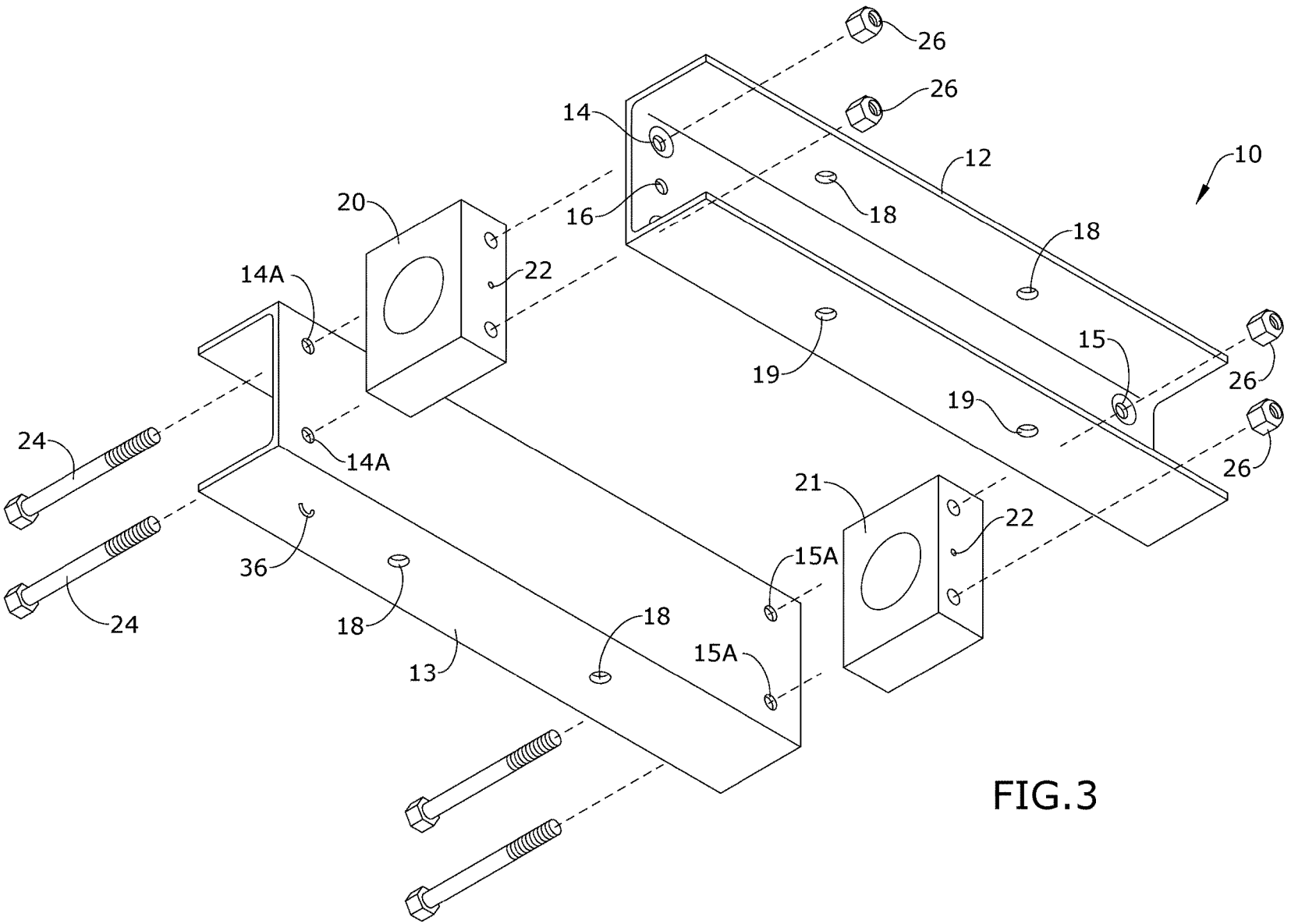
FIG. 3 shows an exploded view of a carrier assembly of one embodiment of the present invention.
Figure 4:
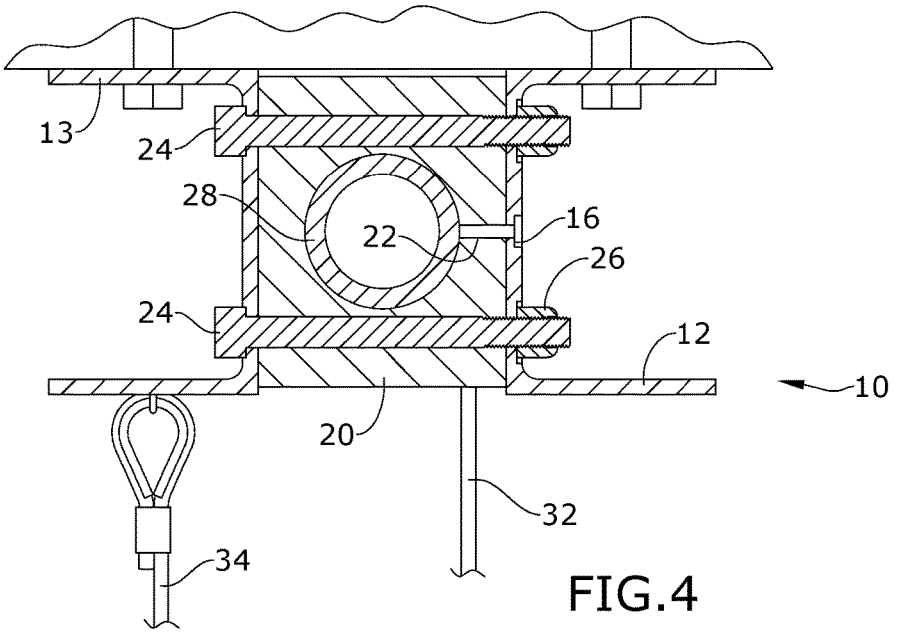
FIG. 4 shows a section view of one embodiment of the present invention taken along line 4-4 in FIG. 1.
Figure 5:
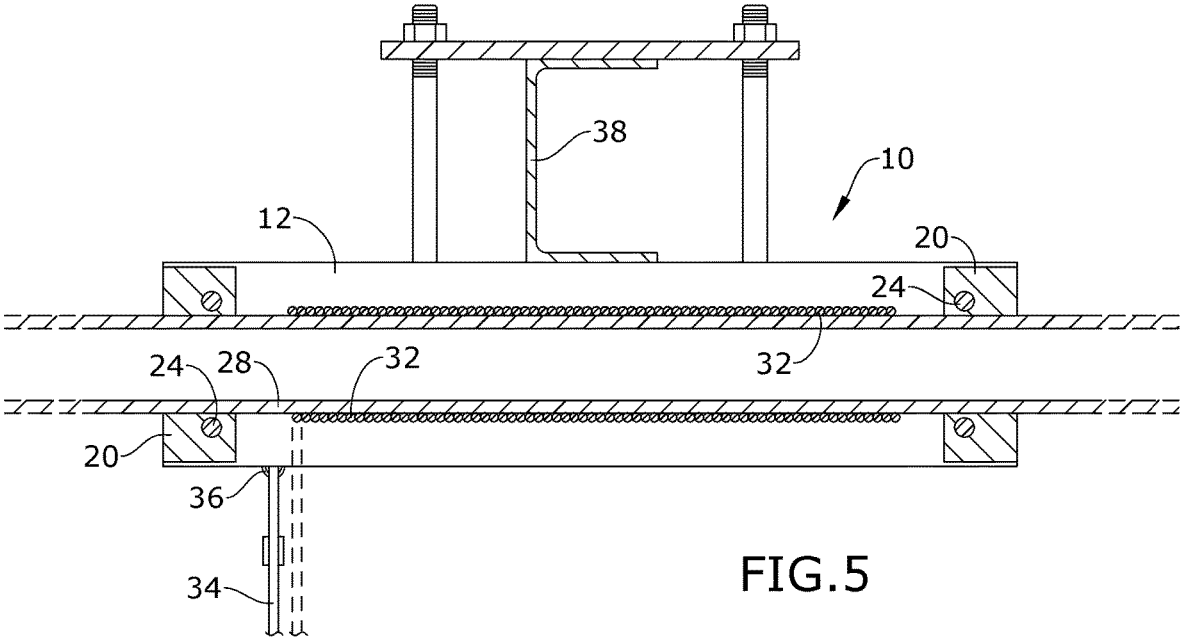
FIG. 5 shows a section view of one embodiment of the present invention taken along line 5-5 in FIG. 1.

By way of example, and referring to FIGS. 1-5, one embodiment of a boat hoist carrier 10 is configured to lift a vessel above a ground surface. The boat hoist carrier 10 further comprises a first aluminum c-channel 12 further comprising a first plurality of block attachment openings 14, a second plurality of block attachment openings 15, at least one first channel grease opening 16, a first plurality of structure attachment openings 18, and a second plurality of structure attachment openings 19.

A first billet aluminum pillow block 20 is joined to the first plurality of block attachment openings 14. A second billet aluminum pillow block 21 is joined to the second plurality of block attachment openings 15. A second aluminum c-channel 13 further comprises a third plurality of billet aluminum pillow block attachment openings 14A, a fourth plurality of block attachment openings 15A at least one second channel grease opening 17, the third plurality of block attachment openings 14A is attached to the first billet aluminum pillow block 20, and a fourth plurality of block attachment openings 15A is attached to the second billet aluminum pillow block 21.

A drive pipe 28 is arranged through the first billet aluminum pillow block 20 and the second 34 and tethered to a line attachment point 36 on the first aluminum c-channel 12. A motor 30 is attached to the drive pipe 28. The motor 30 coils or uncoils the dead hoist line 34 from the drive pipe 28 causing the vessel to raise or lower.

A first set of carrier attachment bolts 24 is arranged through the first plurality of structure attachment openings 18 the first billet aluminum pillow block 20 and the third plurality of structure attachment openings 18 and secured with a first set of nuts 26. A second set of carrier attachment bolts 24 is arranged through the second plurality of structure attachment openings 18, the second billet aluminum pillow block 20, and the fourth plurality of structure attachment openings 18 and secured with a second set of nuts 26.

A reduction gear (not shown) can be attached to the motor 30 in order to change a rotational speed and a rotational torque of the motor 30. An overhead structure 38 is attached to the first aluminum c-channel 12 and the second aluminum c-channel 12 in order to provide structural support for the boat hoist carrier 10.

In some embodiments, a second boat hoist carrier 10 can be arranged parallel to the first boat hoist carrier 10 along the drive pipe 28.

As used in this application, the term "a" or "an" means "at least one" or "one or more."

As used in this application, the term "about" or "approximately" refers to a range of values within plus or minus 10% of the specified number.

As used in this application, the term "substantially" means that the actual value is within about 10% of the actual desired value, particularly within about 5% of the actual desired value and especially within about 1% of the actual desired value of any variable, element or limit set forth herein.

All references throughout this application, for example patent documents including issued or granted patents or equivalents, patent application publications, and non-patent literature documents or other source material, are hereby incorporated by reference herein in their entireties, as though individually incorporated by reference, to the extent each reference is at least partially not inconsistent with the disclosure in the present application (for example, a reference that is partially inconsistent is incorporated by reference except for the partially inconsistent portion of the reference).

A portion of the disclosure of this patent document contains material which is subject to copyright protection. The copyright owner has no objection to the facsimile reproduction by anyone of the patent document or the patent disclosure, as it appears in the Patent and Trademark Office patent file or records, but otherwise reserves all copyright rights whatsoever.

Any element in a claim that does not explicitly state "means for" performing a specified function, or "step for" performing a specified function, is not to be interpreted as a "means" or "step" clause as specified in 35 U.S.C. § 112, ¶6. In particular, any use of "step of" in the claims is not intended to invoke the provision of 35 U.S.C. § 112, ¶6.

Persons of ordinary skill in the art may appreciate that numerous design configurations may be possible to enjoy the functional benefits of the inventive systems. Thus, given the wide variety of configurations and arrangements of embodiments of the present invention the scope of the invention is reflected by the breadth of the claims below rather than narrowed by the embodiments described above.

What is claimed is:

1. A boat hoist carrier, configured to lift a vessel above a ground surface; the boat hoist carrier further comprising:

a first aluminum c-channel further comprising a first plurality of block attachment openings, a second plurality of block attachment openings, at least one first channel grease opening, a first plurality of structure attachment openings, and a second plurality of structure attachment openings;

a first billet aluminum pillow block joined to the first plurality of block attachment openings;

a second billet aluminum pillow block joined to the second plurality of block attachment openings;

a second aluminum c-channel further comprising a third plurality of block attachment openings attached to the first billet aluminum pillow block, and a fourth plurality of block attachment openings attached to the second billet aluminum pillow block;

a drive pipe, arranged through the first billet aluminum pillow block and the second billet aluminum pillow block;

a live host line, coiled around the drive pipe forming a dead hoist line and tethered to a line attachment point on the first aluminum c-channel; and a motor, attached to the drive pipe, wherein arranging the motor coils or uncoils the dead hoist line from the drive pipe causing the vessel to raise or lower.

2. The boat hoist carrier of claim 1, further comprising a first set of carrier attachment bolts, arranged through the first plurality of structure attachment openings, the first billet aluminum pillow block and the third plurality of structure attachment openings and secured with a first set of nuts.

3. The boat hoist carrier of claim 2, further comprising a second set of carrier attachment bolts, arranged through the second plurality of structure attachment openings, the second billet aluminum pillow block and the fourth plurality of structure attachment openings and secured with a second set of nuts.

4. The boat hoist carrier of claim 3, further comprising an overhead structure, attached to the first aluminum c-channel and the second aluminum c-channel in order to provide structural support for the boat hoist carrier.

* * * * *